US006287085B1

(12) United States Patent
Goettel et al.

(10) Patent No.: US 6,287,085 B1
(45) Date of Patent: Sep. 11, 2001

(54) RAPID UNLOADER RETROFITS

(75) Inventors: Walter E. Goettel, Monogahela; Ronald J. Shaffer, Pittsburgh, both of PA (US)

(73) Assignee: Westinghouse Air Brake Company, Wilmerding, PA (US)

( * ) Notice: Subject to any disclaimer, the term of this patent is extended or adjusted under 35 U.S.C. 154(b) by 0 days.

(21) Appl. No.: 09/491,856

(22) Filed: Jan. 26, 2000

(51) Int. Cl.[7] ..... F04B 23/00; F04B 49/00; F01D 5/08

(52) U.S. Cl. ..... 417/243; 417/307; 415/179

(58) Field of Search ..... 417/243, 307; 415/179

(56) References Cited

U.S. PATENT DOCUMENTS 2,482,626 * 9/1949 Lamberton ..... 230/211
2,576,876 * 11/1951 Gamble ..... 230/182
3,096,927 * 7/1963 Wahl ..... 230/26
4,288,204 * 9/1981 Viertier ..... 417/243
5,106,270 * 4/1992 Goettel et al. ..... 417/243
5,195,874 * 3/1993 Odagiri ..... 417/6

* cited by examiner

*Primary Examiner*—Timothy S. Thorpe
*Assistant Examiner*—Timothy P. Solak
(74) *Attorney, Agent, or Firm*—James Ray & Associates

(57) ABSTRACT

Retrofit apparatus is provided for rapidly exhausting air pressure from one or more intercoolers connected in fluid communication between two low pressure heads of an air compressor and a high pressure head of the compressor. The retrofit apparatus comprises an unloader valve, a center header for commonly connecting the intercoolers to the high pressure head, and means for connecting the unloader valve to the center header to effect rapid unloading of the header and the intercoolers connected thereto of pressurized air when the valve receives a compressor unload signal.

8 Claims, 4 Drawing Sheets

RAPID UNLOADER RETROFITS

FIELD OF THE INVENTION

The present invention relates, in general, to retrofit manifold structures for rapidly exhausting air from two intercoolers connected to receive air pressure from the low pressure cylinders of an air compressor. The intercoolers hereinafter represent volumes of the cooling cores of the two intercoolers and all associated piping/connectors which, also, have their own volumes which must be exhausted rapidly in accordance with the principles of the invention.

BACKGROUND OF THE INVENTION

U.S. Pat. No. 5,106,270 to Goettel et al discloses an air compressor comprised of two low pressure cylinders and cylinder heads each of which discharges low pressure air into two respective intercoolers to cool the compressed air before it enters a common manifold connection and inlet flange of a high pressure cylinder and cylinder head. A single intercooler core design is also available that collectively receives the air discharged from such low pressure cylinder heads and cools the air before entering the high pressure head's inlet flange for the second stage of compression.

An unloader valve has been connected to the bottom of the lower plenum of the single type intercooler for rapidly unloading pressurized air before the electric motor that drives the compressor is started. Such disclosure is made in U.S. Pat. No. 6,026,587, Dated Feb. 22, 2000, which is assigned to the assignee of the present application and is fully incorporated herein by reference.

The compressor in the above incorporated application, and in other compressors, and in that of the above Goettel et al. patent can be driven by an electric motor, though in times past, compressors in locomotives were driven directly by the diesel engine of the locomotive. In this manner, while the diesel engine was idling, the compressor continued to run, though at the slower idle speed of the diesel engine.

More recent compressor designs, however, are operated by electric motors in a stop/start fashion. In this mode of operation, the compressors are started when pressurized air is needed and stopped when pressurized air is not needed. Such electric motors operate from a voltage generated by an alternator, disposed in the locomotive, which is driven by the diesel engine of the locomotive. When diesel engine RPM is low, such as in an idle condition, the alternator produces only a limited amount of electrical power. Such a limited amount of power may be insufficient to operate the compressor motor at a speed sufficient for the compressor to deliver the required amount of compressed air to the train. When this occurs, the air compressor needs to operate at a speed greater than that at which the motor is capable of when it is only supplied by the electrical characteristics of the alternator.

For this reason, compressor motors may have a dual pole, dual speed configuration. For example, the motor may consist of the same number of magnetic poles as the supply voltage alternator. For low speed operation, since the poles of the motor and alternator are equal, the compressor turns at essentially the same speed as the alternator (and the mechanical drive of the diesel engine) less any losses, of course.

If the compressor can run faster than engine speed (such as an idle speed), to assure a compressed air output to overcome train line losses, there will be only the need to reduce the number of active motor poles. For example, if the number of motor poles is reduced in half, the compressor will run at twice the diesel engine/alternator speed. In this manner, the locomotive crew can operate the locomotive at a lower engine speed (to save fuel and reduce engine wear) while, at the same time, produce a sufficient amount of compressed air for the brakes and other pneumatically operated devices.

When additional air pressure is called for, the compressor motor is signaled to operate at the higher speed. When this occurs, the compressor is unloaded (exhausted) of air pressure so that the motor can start (transition) under unloaded conditions. When the compressor is unloaded, the compressor rotates freely and thus places a very light load on the electric motor. If the motor is required to start or transition against a pressure load in the compressor, the rotor of the compressor can appear to the motor to be locked, and can thereby burn out the motor, as the motor draws large amounts of current to overcome the force of compression in the compressor.

The compressor rotor includes a crankshaft that operates the pistons located in the cylinders of the compressor. The pistons are the mechanism by which the compressed air is formed in the compressor. It is therefore understandable that with air pressure in the cylinders acting against the pistons and thus against the crankshaft of the compressor, the electric motor connected to drive the compressor has a difficult task in rotating the crankshaft.

The air compressor will normally unload when the increase in the main reservoir pressure reaches about 140 psig. At this point, a compressor governor or compressor control switch admits air to an unloader line connected to unloader inlet valves located on the compressor cylinder heads to move and hold an inlet valve off its seat thereby preventing further compression of air. The cylinders, cylinder heads and intercooler(s) are vented to atmosphere via an exhaust vent in the unloader valve. The intercooler pressure vents to atmosphere through the unloader valves and vents. Such unloader venting takes about 25 seconds.

Historically, this time period was not important because the compressor was operated constantly by the diesel engine of the locomotive and would load and unload as needed (under the control of the above governor). The time it takes for a dual pole configuration motor to transition from its relatively slow speed (twelve pole) operation to the doubling high speed (six pole) operation is on the order of two to three seconds. Hence, when the motor changes speed there may still be air pressure in the high pressure head of the compressor, as supplied by the two intercoolers, for example, disclosed in the above Goettel et al patent. It is therefore important that air pressure in both intercoolers be discharged quickly so that the compressor motor does not have to start, i.e., change speeds, against a pressure load in the high pressure cylinder of the compressor.

As best seen in FIG. 3 of the drawings in the above Goettel et al. patent, a center header or manifold commonly joins the output of the two intercoolers to the high pressure head of the compressor. The center header is a hollow casting having opposed flanges for connecting two pipes from two low pressure heads of the compressor and a flanged, perpendicular, integral portion that extends to the input of the high pressure head. In the lateral center of the casting, between the two flanges that join the two intercoolers, is a relief valve threaded into an upper wall of the casting.

SUMMARY OF THE INVENTION

The present invention solves the problem of unloading pressurized air from the two Goettel et al. intercoolers by using an exhaust or blowdown valve connected directly to the intercoolers at the location of the existing flanged center header that connects the intercoolers to the high pressure cylinder. In one embodiment of the invention, a hole is drilled in a bottom wall of such center header and a hollow boss is welded to such bottom wall at the location of the drilled hole. A blowdown or unloader valve is connected in communication with the hollow boss and thus with the drilled hole and the interior of the center header.

In a second embodiment of the invention a bracket is attached to the high pressure cylinder flange of the interconnecting header, using the bolts that attach the header to the high pressure cylinder, the brackets serving to mount the blowdown valve immediately beneath the interconnecting center header. The blowdown valve is connected to a port already existing in the header wall by a short section of hose.

In a third embodiment of the invention, an adapter fitting is threaded into an existing upper threaded opening that presently receives and mounts the earlier mentioned relief valve. The adapter is provided with opposed lateral openings, one of which receives the relief valve while the other receives a threaded nipple of a blowdown valve.

In all three embodiments, the blowdown or unloader valve is located between the two intercoolers at the location of the intercooler connection to the high pressure cylinder so that when the blowdown valve is activated by a pilot signal that orders unloading of the compressor, air pressure is immediately vented from the two intercoolers, the low pressure cylinder heads and the high pressure cylinder head. In this matter, when a drive motor starts or changes speed, the intercoolers and high pressure head of the compressor are exhausted of pressurized air so that the motor can start or transition in an unloaded condition.

OBJECTS OF THE INVENTION

It is, therefore, a primary objective of the invention to provide one or more simple retrofit structures for supporting a blowdown valve at a location between two intercoolers for rapid exhaustion of intercooler air pressure, including the volumes of associated piping and fittings, when the compressed air of an air compressor reaches a compressor governor's unloader pressure setting. This allows a compressor motor speed change to occur on a substantially unloaded compressor.

The above objective and various additional objectives and advantages of the invention will become more apparent to those skilled in the air compressor art from consideration of the following detailed description of the invention, particularly, when such description is taken in connection with the attached drawing Figures.

PRESENTLY PREFERRED EMBODIMENTS OF THE INVENTION

Figure 1:
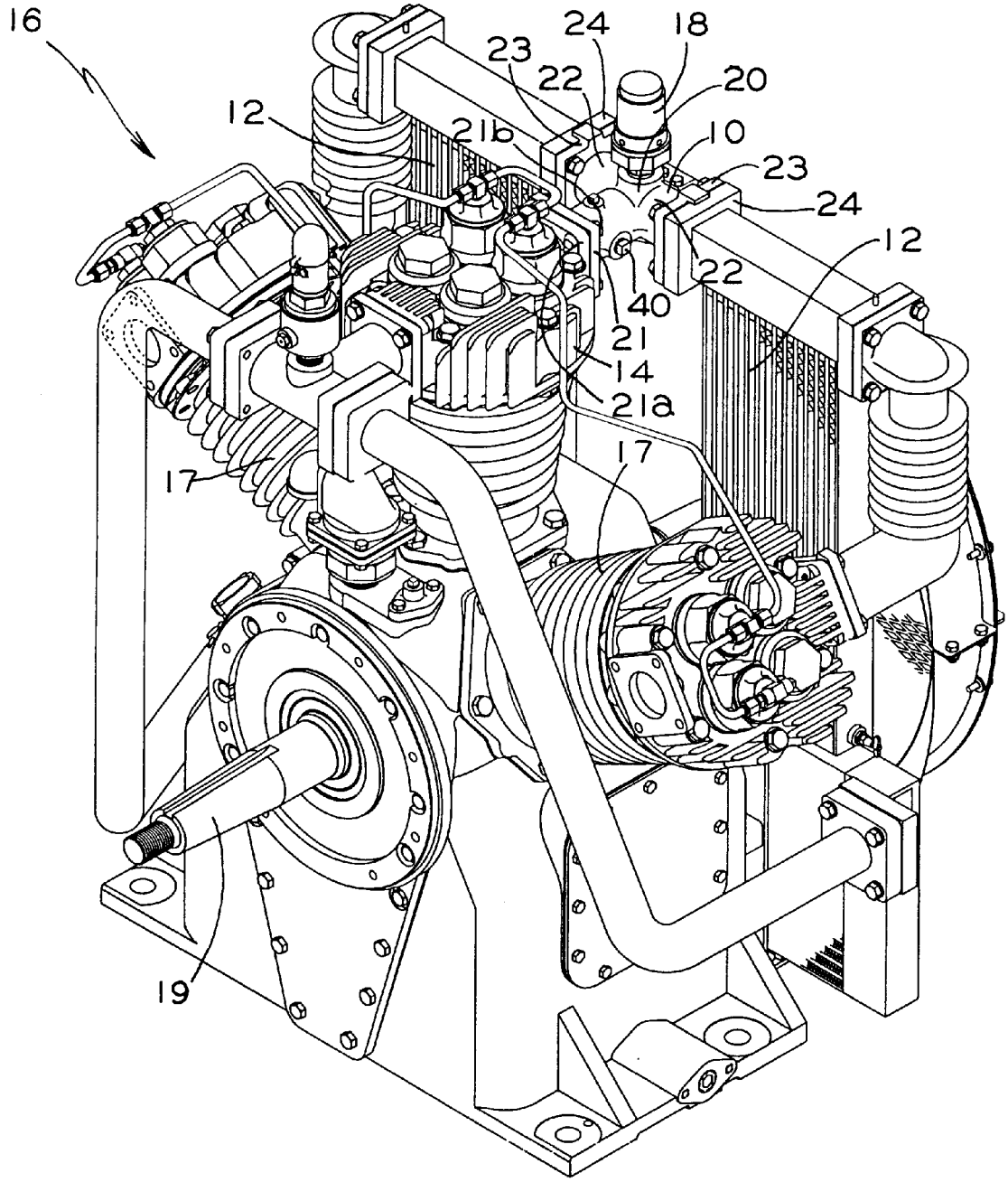
FIG. 1 PRIOR ART
FIG. 1 is a perspective view of a three stage air compressor in which the prior art center header manifold connection commonly connects the outputs of two intercoolers to the input of a high pressure cylinder.

Prior to proceeding to the more detailed description of the present invention, it should be noted that identical components having identical functions have been identified with the same reference numerals throughout the several views illustrated in the drawing figures for the sake of clarity and understanding of the invention.

Referring now to FIG. 1 of the drawings, a prior art center header 10 is shown commonly connecting the outputs of two intercoolers 12 to the input opening of a high pressure cylinder head 14 of a three cylinder air compressor 16. Two low pressure cylinders are labelled with numeral 17. A pressure relief valve 18 is shown mounted on and connected to the interior of center header 10.

A drive motor (not shown) is mechanically connected to a shaft 19 of compressor 16 for operating the compressor in a well known manner.

The center header 10 is an integral, one piece, cast manifold having a center extension 20 and two extensions 22 located at right angles to the axis of the center extension. Extension 20 has an integral flange 21 that is bolted to a flanged face 21A of cylinder 14, using bolts 21B. Extension 22 has integral flanges 23 for bolting onto flanged outputs 24 of intercoolers 12.

The above pending U.S. patent application Ser. No. 09/113,983 discusses an early valve assembly (shown in FIG. 1 of the application) for unloading (venting to atmosphere) air pressure in a cylinder head and intercooler when an unload, pneumatic signal is communicated to the underloader valve assembly. In locomotives, the unload signal originates in the main reservoirs of such locomotives. A governor is employed to control the operation of the compressor using a pressure sensitive switch having a setting that "cuts out" compressor operation when reservoir pressure reaches a cut-out pressure level (on the order 140 psig). when reservoir pressure decreases to a "cut in" level and setting of the governor's pressure switch, the valve closes enabling the compressor to compress air.

A substantial improvement over the early valve is also disclosed in the above pending U.S. Application that allows more rapid unloading of compressor cylinders and intercoolers than that of the early valve. The improved valve has been used on single intercooler units to unload the intercooler when a compressor unload signal reaches the valve. The valve has been mounted on the bottom header of the intercooler and in fluid communication with the interior of the header.

With the use of double intercoolers, as shown in FIG. 1 of the drawings, to effect simultaneous, rapid unloading of both intercoolers would ordinarily require the use of two unloader valves, one on each intercooler. If only one such valve was used to unload two intercoolers, the intercooler remote from the intercooler having the unloader valve would have to vent serially through the intercooler with the valve. This would prolong venting of the intercoolers such that the rapid (two second) change of a two pole configuration electric motor would have to start against a loaded compressor.

Figure 2:
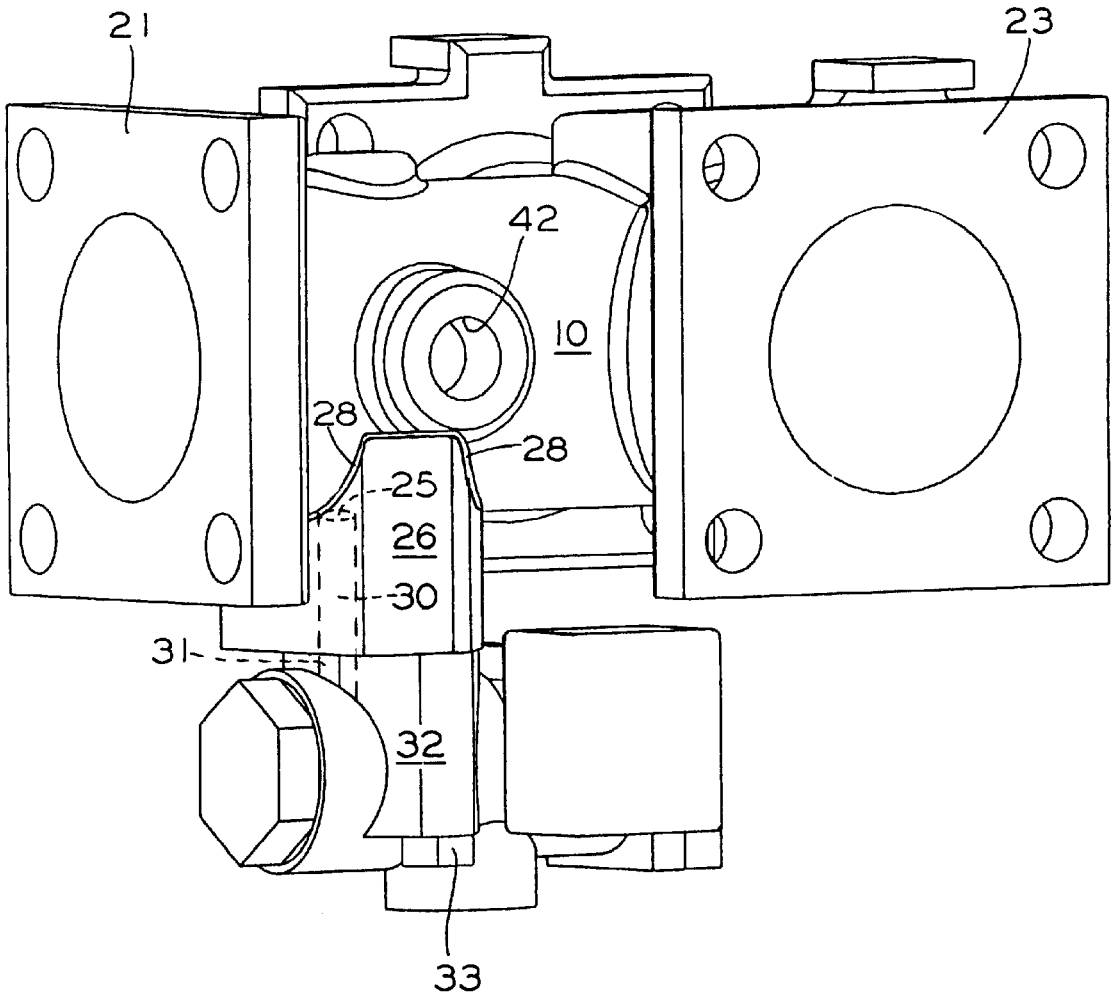
FIG. 2 is perspective view of the interconnecting center header of FIG. 1 provided with a hollow boss welded to the lower wall of the header and supporting a lower unloader valve in fluid communication with the interior of the header.

In a first embodiment of the present invention (FIG. 2), the center location of header 10 is used to simultaneously and thus quickly unload both intercoolers 12 of a twin intercooler unit and the associated high pressure cylinder of an air compressor to which the intercoolers are connected. This is effected by a simple retrofit of the header by providing a hole 25 (shown in dash outline in FIG. 2 of the drawings) in a lower wall portion of the header and then welding a boss member 26 to the lower wall section, as indicated by the weld bead 28 in FIG. 2 of the drawings. The boss member has a passageway 30 (shown also in dash outline in FIG. 2) extending downwardly through the body of the boss, the upper end of which is located in alignment with opening 25 when the boss is welded to header 10. The lower end of passageway 30 is aligned with a port 31 of an unloader valve 32 when the valve is suitably attached, such as by bolts 33, to the lower end of the boss. Only one such bolt is visible in the view of FIG. 2.

Thus, when valve 32 receives a pneumatic unload signal, compressed air rapidly passes from center header 10 through the opening 25 provided therein, down through passageway 30 in boss 26, and through a large exhaust port (not visible in FIG. 2) of valve 32. The compressor drive motor now can start against an unloaded high pressure cylinder 14 (FIG. 1) and unloaded low pressure cylinders 17 of the compressor.

When the unload signal is removed from valve 32, its exhaust port closes so that the compressor can compress air under the mechanical power provided by its drive motor.

Figure 3:
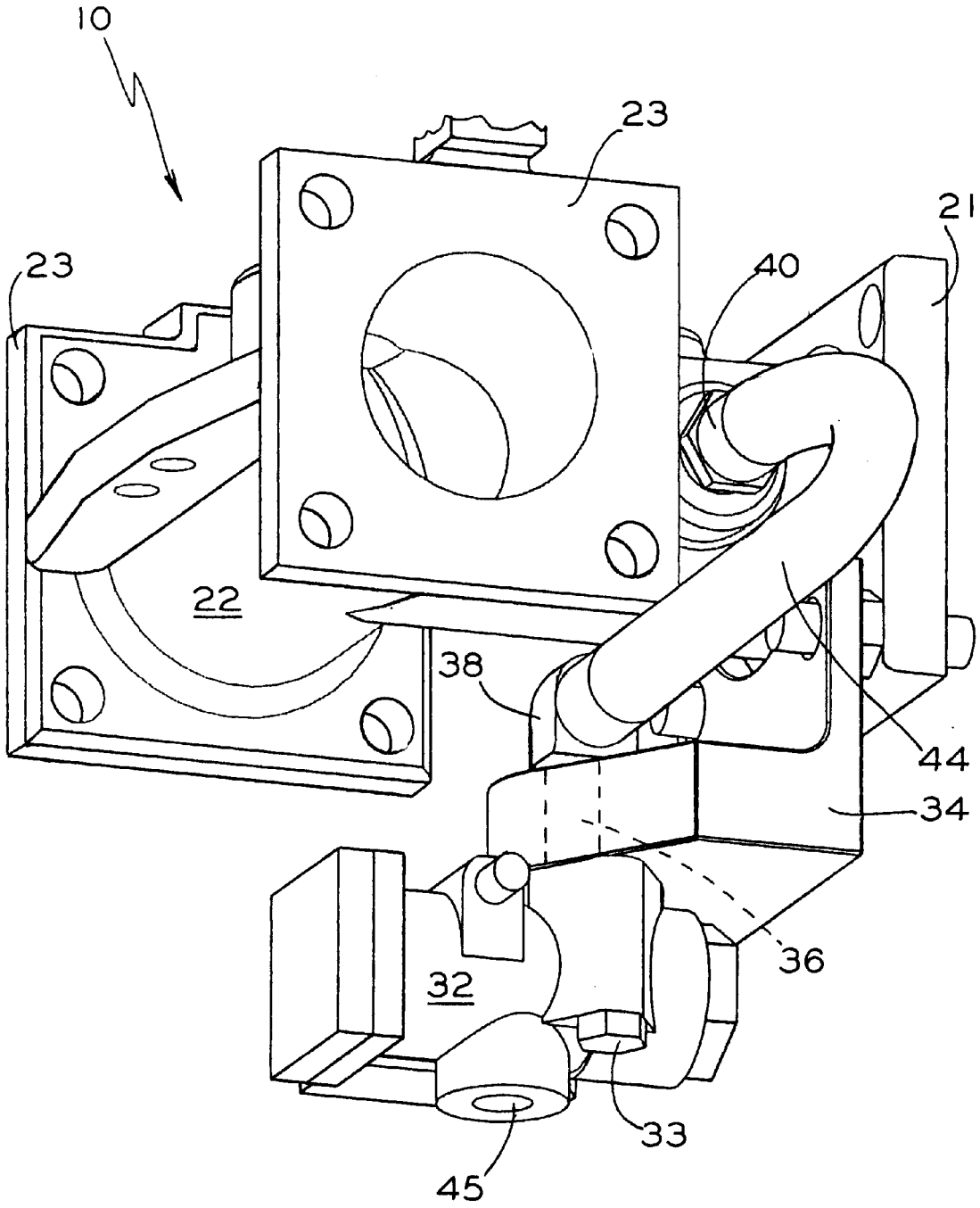
FIG. 3 is a perspective view of an L-shaped bracket connected to the high pressure flange of the center header and supporting a lower positioned unloader valve connected in fluid communication with the interior of the header by use of a hose connected to an existing port provided in a side wall of the header manifold.

FIG. 3 of the drawings shows a second retrofit embodiment of the invention using, again, the convenient center location of header 10. In this embodiment, an L-shaped bracket 34 is bolted to the flanged face 21A of cylinder 14 (FIG. 1) using the bolts 21B (or similar type bolts) ordinarily and originally used to bolt the flange 21 of header 10 to the cylinder. In the present case of FIG. 3, bolts 21B bolt both the bracket 34 and the flange 21 of the center header to the flanged face 21A of cylinder 14 (FIG. 1).

In FIG. 3, bracket 34 is provided with a vertical opening or passageway 36 for receiving in its upper end a hollow fitting 38. Its lower end is aligned with a port (not visible in FIG. 3) of unloader valve 32 secured to the underside of the bracket by bolts 33, only one of which is visible in FIG. 3. In this manner, valve 32 is connected in fluid communication with fitting 38 via the opening 36 provided in bracket 34.

As seen in the view of original center header 10 depicted in FIG. 1 of the drawings, plugs 40 are ordinarily used to plug holes provided in the wall of the header. In the embodiment of FIG. 3, the plug closest to fitting 38 is removed from the header to reveal a port 42 (in FIG. 2), and a flexible hose 44, shown in FIG. 3, is connected between fitting 38 and port 42 (again, visible only in FIG. 2) provided in the side wall of header 10. If plug 40 and port 42 are threaded, the upper end of hose 44 can be provided with a threaded fitting (not shown) for threading into port 42.

Similarly, fitting 38 can have an integral threaded nipple (not visible in FIG. 3) for threading into an internally threaded upper end of passageway 36 provided in bracket 34.

Again, when valve 32 receives an unload signal, an exhaust port 45 (FIG. 3) of the valve is opened and compressed air flows freely and rapidly from center header 10, to and through hose 44 to fitting 38 and through exhaust port 45 of valve 32. In this manner, the compressor drive motor can start or change speeds under the condition of an unloaded compressor.

Figure 4:
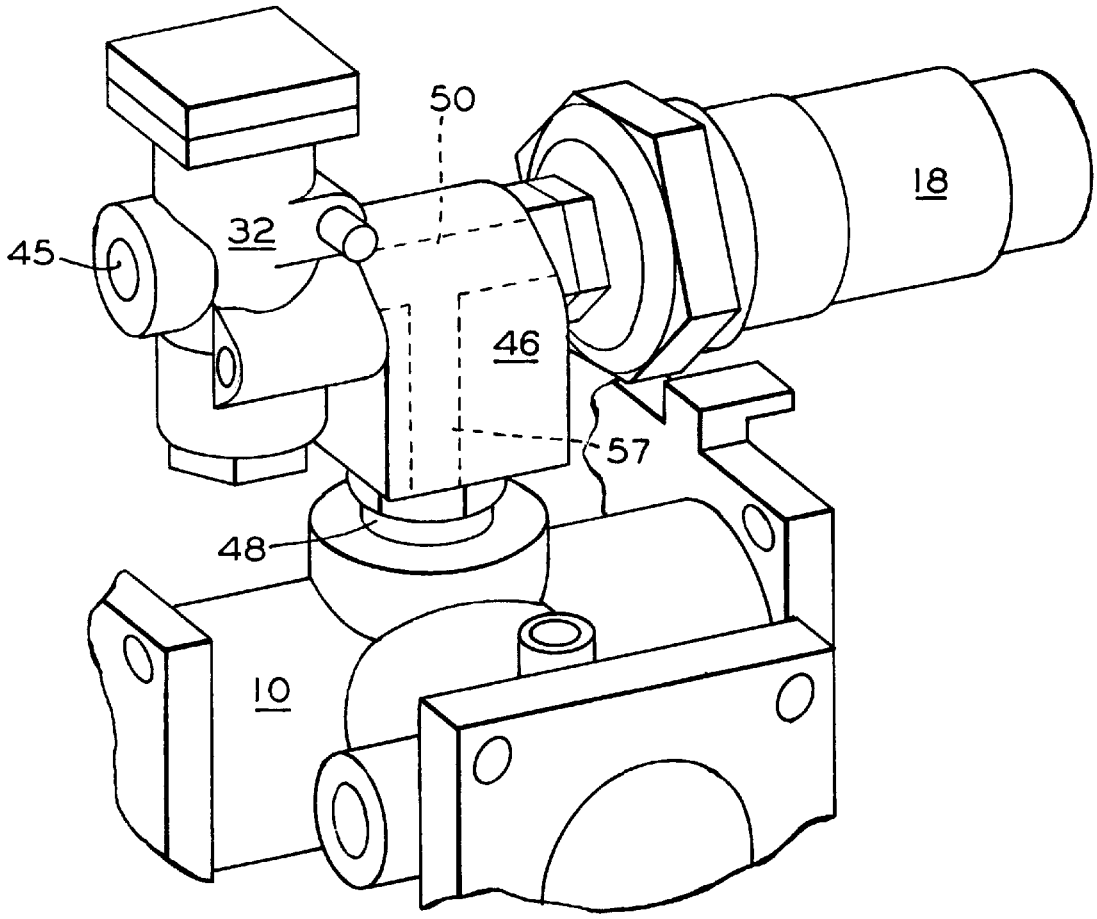
FIG. 4 is a perspective view of a third embodiment of the invention in which a simple hollow adapter is threaded into an existing upper port of the header, which port presently receives and holds the above mentioned pressure relief valve, the adapter having two lateral openings or ports for receiving respectively the relief valve on one end of the adapter and a blowdown valve on the other end of the adapter.

FIG. 4 of the drawings shows a third embodiment of the invention in which an upper plug 40 is removed from the center header 10 to be replaced by an adapter fitting 46 having an integral hollow nipple 48 for threading into the opening of the header that original received pressure relief valve 18 (FIG. 1).

The adapter fitting 46 has a transverse passageway 50 (depicted in dash outline in FIG. 4) connected in direct fluid communication with the hollow interior of nipple 48 via a bore 57 located generally normal to the axis of passageway 50 and in direct fluid communication with a pressure relief valve 18 located in one end of the fitting but now in a horizontal position. An unloader valve 32 is located in the other end of the fitting; its exhaust port 45 faces outwardly from the assembly of adapter 46, relief valve 18 and unloader valve 32. In this manner, the center header is retrofitted in a convenient way to provide both pressure relief and unloading exhaustion of the intercooler pair 12. No new costly apparatus is needed, i.e., only the simple adapter fitting 46 is required in this embodiment. The opposed ends of transverse passageway 50 in the adapter fitting can be threaded to quickly receive threaded nipples of relief valve 18 and unloader valve 32.

In all three embodiments of the invention, the center location of header 10 is employed to rapidly exhaust twin intercoolers 12 and all of its associated tubing and piping, as well as the high pressure cylinder 14 of compressor 16 so that the compressor can start and/or change speeds in an unloaded manner.

Similarly, in all three embodiments, the center header 10 is used "as is" except for the hole 25 provided in the wall of the header in the first embodiment (FIG. 2) for communication with the interior passageway 30 of the boss 26, which is welded to the header wall.

While presently preferred embodiments for carrying out the instant invention have been set forth in detail above, those persons skilled in the unloader valve art to which this invention pertains will recognize various alternative ways of practicing the invention without departing from the spirit and scope of the patent claims appended hereto.

What is claimed is:

1. Retrofit apparatus for rapidly exhausting air pressure from one or more intercoolers connected in fluid communication between two low pressure heads of an air compressor and a high pressure head of the compressor, the retrofit apparatus comprising:

an unloader valve, a center header for commonly connecting said intercoolers to the high pressure head, and means for connecting said unloader valve to said center header to effect rapid unloading of the header and the intercoolers connected thereto of pressurized air when the valve receives a compressor unload signal.

2. The apparatus of claim 1 wherein the means for connecting the unloader valve to the center header is a hollow boss member connected to the center header at a location of an opening provided in a wall of said header.

3. The apparatus of claim 2 wherein the hollow boss member is welded to the center header.

4. The apparatus of claim 1 wherein the means for connecting the unloader valve to the center header is a hose connected to and extending between two ports provided respectively in the center header and in the unloader valve.

5. The apparatus of claim 1 wherein a bracket is used to mount the unloader valve in close proximity to the center header using bolts that connect the header to a flanged opening of the high pressure cylinder.

6. The apparatus of claim 1 wherein the means for connecting the unloader valve to the center header is an adapter fitting having a threaded nipple for threading in a threaded opening provided in a wall of said center header, said fitting having two, opposed openings located at substantially right angles to the threaded nipple and connected in direct fluid communication with the threaded opening provided in the wall of said center header.

7. Apparatus for rapidly exhausting air pressure from two intercoolers connected in fluid communication between two low pressure heads of an air compressor and a high pressure head of the compressor, the apparatus comprising:

a center header for commonly connecting the two intercoolers to the high pressure head of the compressor, an opening provided in a wall of said center header, a hollow boss connected to said wall at the location of said opening, and an unloader valve mounted on said boss in a manner which connects the valve in fluid communication with the opening provided in said center header and thus in fluid communication with the interior of said header for rapidly exhausting air from the two intercoolers and center header when the valve receives a compressor unload signal.

8. Apparatus for rapidly exhausting air pressure from two intercoolers connected in fluid communication between two low pressure heads of an air compressor and a high pressure head of the compressor, the apparatus comprising:

a center header for commonly connecting the intercoolers to the high pressure head, said center header having a port provided in a wall of the header, which port is normally closed to the atmosphere outside of the header, a valve for unloading the intercoolers and high pressure head of said compressor, a fitting connected to an inlet port provided in said unloader valve, a hose having one end for connection to the port in said center header, while the other end of said hose is located for connection to the fitting connected to the inlet port of said valve, and a bracket for mounting said valve on the compressor at a location in close proximity to said center header.

* * * * *